US005602897A

United States Patent [19]

Kociecki et al.

[11] Patent Number: 5,602,897

[45] Date of Patent: Feb. 11, 1997

[54] HIGH-VOLTAGE POWER SUPPLY FOR X-RAY TUBES

[75] Inventors: John Kociecki, Chagrin Falls; Theodore A. Resnick, Beachwood, both of Ohio

[73] Assignee: Picker International, Inc., Highland Heights, Ohio

[21] Appl. No.: 496,571

[22] Filed: Jun. 29, 1995

[51] Int. Cl.[6] ..... H05G 1/10; H05G 1/20; H05G 1/32

[52] U.S. Cl. ..... 378/101; 378/105; 378/111

[58] Field of Search ..... 378/101, 104, 378/105, 106, 107, 108, 109, 110, 111, 112, 4; 363/41, 64

[56] References Cited

U.S. PATENT DOCUMENTS

| | | | |
|---|---|---|---|
| 4,168,436 | 9/1979 | Aradate et al. | 378/106 |
| 4,488,214 | 12/1984 | Chambers | 363/71 |
| 4,805,081 | 2/1989 | Chambers et al. | 363/96 |
| 5,023,768 | 6/1991 | Collier | 363/68 |
| 5,267,138 | 11/1993 | Shores | 363/98 |
| 5,305,363 | 4/1994 | Burke et al. | 378/4 |

*Primary Examiner*—Don Wong

*Attorney, Agent, or Firm*—Fay, Sharpe, Beall, Fagan, Minnich & McKee

[57] ABSTRACT

An x-ray tube of a CT scanner is powered by a high-voltage power supply (26). The high-voltage power supply includes a plurality of sections (102) each having three straight-up transformers (48) which receive three 120° phase shifted alternating current components as inputs. The straight-up transformers perform a direct voltage transformation with single or multiple transformers and with no capacitive multipliers. Each straight-up transformer has a primary winding (T1) and two secondary windings (T1-A, T1-B). The secondary windings are connected together in delta and wye configurations (84). The alternating current components have their voltage boosted and are rectified and summed to form a high-voltage output that is substantially ripple-free. A pulse-width modulated converter (34) generates a conditioned output current from an inputted direct current. Resonant inverters (36) receive the conditioned output current and convert the conditioned, direct current into alternating current received by each of the straight-up transformers (48) in the stack. The resonant inverters (36) operate at or near resonance. The power supply (26) has no added capacitance and stores a minimum of energy. It provides rise and fall times which enable the x-ray tube to perform sub-second exposures with very short rise and fall times.

23 Claims, 13 Drawing Sheets

HIGH-VOLTAGE POWER SUPPLY FOR X-RAY TUBES

BACKGROUND OF THE INVENTION

The present invention pertains to the art of high-voltage power supplies. It finds particular application in conjunction with high power generators for CT scanners and will be described with particular reference thereto. However, it is to be appreciated, that the present invention will also find application in conjunction with high-voltage supplies for other purposes.

Early x-ray tubes were provided with oil-filled transformers for providing an unregulated, alternating current source of high-voltage power. The tube itself acted as a rectifier, emitting radiation on alternating half cycles when the anode was positive and the cathode was negative. Subsequently, diode rectifier tubes, filter capacitors, and controlled grid tubes were added to deliver smoother and more stable power, improving image quality and repeatability. By operating at a 60 Hz power line frequency, these x-ray generators were characterized by their large size, heavy weight, and high stored energy. They were also reliable, had a low cost, were well understood, and were relatively simple to manufacture. Of course, they suffered from significant 60 Hz x-ray output fluctuations.

Another type of power supply developed for commercial use was a solid-state switching-type high-voltage power supply. These power supplies incorporated a kilohertz range inverter which reduced the size and weight of an HV transformer and output filter. Kilohertz range ripple had serious detrimental effects, particularly in sensitive x-ray equipment like CT scanners which measure x-ray variation at the detectors with high sampling rates to generate a diagnostic image. To smooth the ripple, capacitors were added at the output. The capacitors stored energy which slowed switching response and contributed to arcing problems. The capacitance emptied its stored energy into the short circuit caused by the arcing increasing anode and other tube damage. These switching power supply generators were also plagued by numerous problems due to their complexity and dependence on SCR inverters, infamous for their commutation failures.

Individual transformers commonly were used to boost line voltage to a few thousand volts. Stacked voltage multipliers, for example, were used to increase the voltage to the +75,000 and −75,000 volt levels commonly applied across today's x-ray tubes. Pairs of diodes or diode bridges or half bridges were connected by capacitors. The current pulses built voltages on the capacitors. A sufficiently large number of diodes and capacitors were connected in series that the voltage at the end had built to about 75,000 volts.

In a cascade arrangement, each transformer had a capacitance connected across its output to act as a voltage source at the voltage level of the transformer output. A sufficient number of the capacitors were connected in series to build the voltage to 75,000 volts or other selected voltage level. The stack of capacitors stored a large amount of energy.

The present invention provides a new and improved high-voltage power supply particularly adapted for x-ray tubes which overcome the above-referenced problems and others.

SUMMARY OF THE INVENTION

In accordance with the present invention, a CT scanner includes a stationary gantry defining a patient receiving region. An x-ray tube is mounted on a rotating frame and rotated about the patient receiving region and transmitting x-rays across the patient receiving region. A radiation detector detects radiation which has traversed the patient receiving region and generates signals indicative of the radiation detected. An image reconstruction processor reconstructs an image representation from the signals generated by the radiation detector. A high-frequency power source supplies power to the x-ray tube by receiving and transforming an alternating current into a high-frequency high-voltage output. The power source includes a straight-up transformer which performs a direct voltage transformation with single or multiple transformers, without capacitive multiplier stages. It has secondary windings connected in a delta-wye configuration.

In accordance with another aspect of the present invention, the power source is configured in compactly stacked circuit sections which operate independently of each other. The circuit sections are separated by contoured parallel plates which grade voltage uniformly. Each circuit section includes a straight-up transformer whose output is combined with the other circuit section outputs to generate the high-frequency high-voltage output supplied to the x-ray tube.

In accordance with another aspect of the present invention, a pulse-width modulated converter receives a direct current and converts it into a modulated output. Inverters receive the modulated output and convert the output to at least a 50 kHz alternating current which is supplied to the stacked circuit sections.

In accordance with a more limited aspect of the present invention, the power source is free of added capacitance and includes at least one cable for connecting the power source to the x-ray tube.

In accordance with a more limited aspect of the present invention, the pulse-width modulated converter includes an IGBT as a switching mechanism.

In accordance with a yet more limited aspect of the present invention, the pulse-width modulated converter includes a MOSFET connected in parallel to the IGBT to control turn-off power dissipation.

One advantage of the present invention is that it generates a voltage having about 3.5% or less ripple without added capacitance.

Another advantage of the present invention is that the power supply has near-zero stored energy.

Another advantage of the present invention is that it reduces electric field stresses within the power supply.

Another advantage resides in very fast switching times.

Other advantages include reduced sensitivity to parasitic inductance and capacitance in the transformers, and the generation of very efficient sine waves of current.

Still further advantages of the present invention will become apparent to those of ordinary skill in the art upon reading and understanding the following detailed description of the preferred embodiments.

BRIEF DESCRIPTION OF THE DRAWINGS

The invention may/take-form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
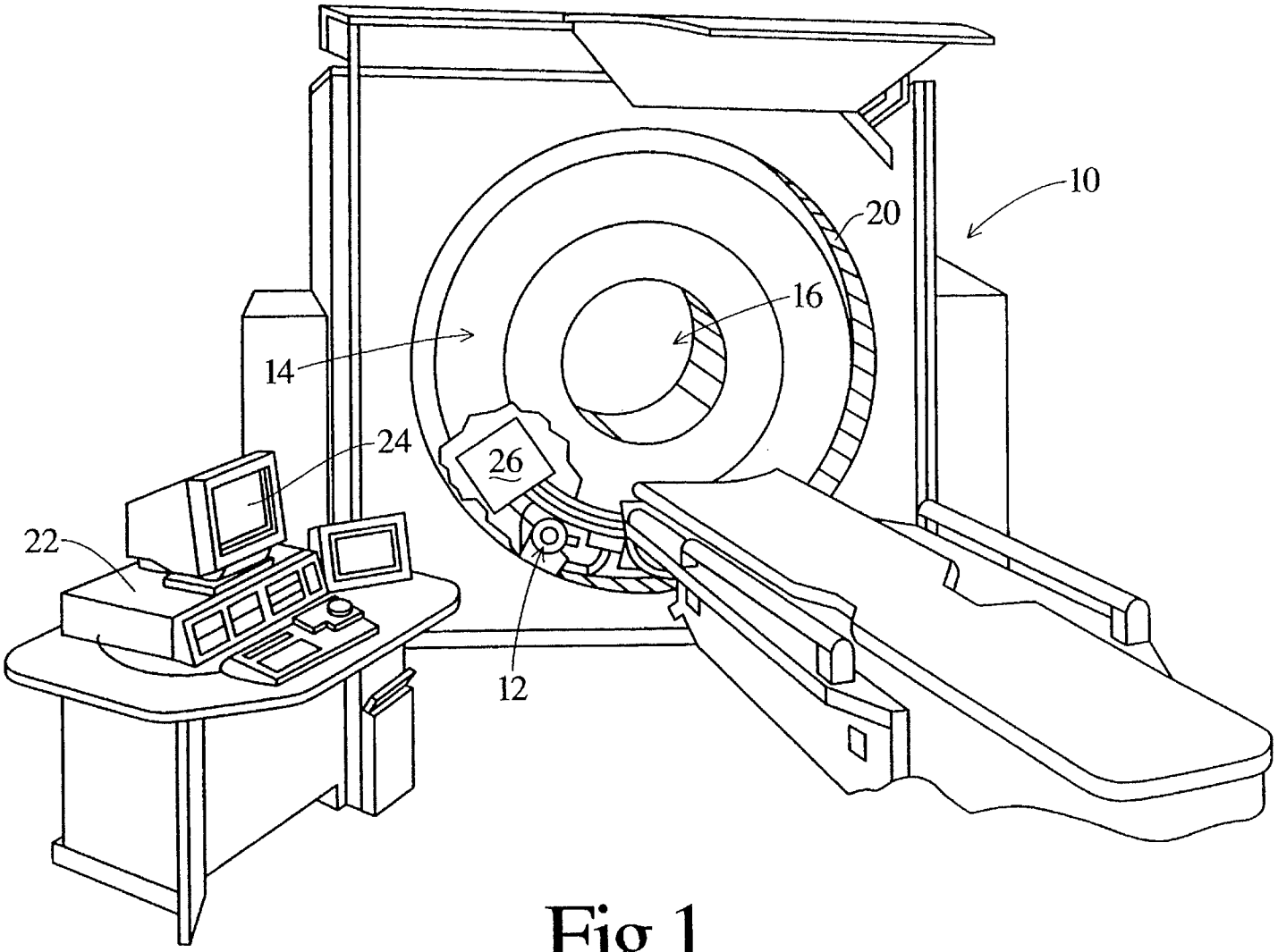
FIG. 1 illustrates a CT scanner in accordance with the present invention.

With reference to FIG. 1, a CT scanner includes a floor mounted or stationary gantry 10 whose position remains fixed during data collection. An x-ray tube 12 is rotatably mounted on a rotating gantry 14. The stationary gantry 10 defines a patient receiving examination region 16. An array of radiation detectors 20 are disposed concentrically around the patient receiving region. In the illustrated embodiment, the x-ray detectors are mounted on the stationary gantry portion such that an arc segment of the detectors receives radiation from the x-ray tube 12 which has traversed the examination region 16. Alternately, an arc segment of radiation detectors can be mounted to the rotating gantry 14 to rotate with the x-ray tube.

A control console contains an image reconstruction processor 22 for reconstructing an image representation out of signals from the detector array 20. Preferably, the image reconstruction processor reconstructs a volumetric image representation from radiation attenuation data taken along a spiral path through the patient. A video monitor 24 converts selectable portions of the reconstructed volumetric image representation into a two-dimensional human-readable display. The console also includes appropriate tape and disk recording devices for archiving image representations, performing image enhancements, selecting planes, 3D renderings, color enhancements, and the like. Various scanner control functions such as gating the x-ray tube on and off, initiating a scan, selecting among different types of scans, calibrating the system, and the like are also performed at the control console.

Figure 2:
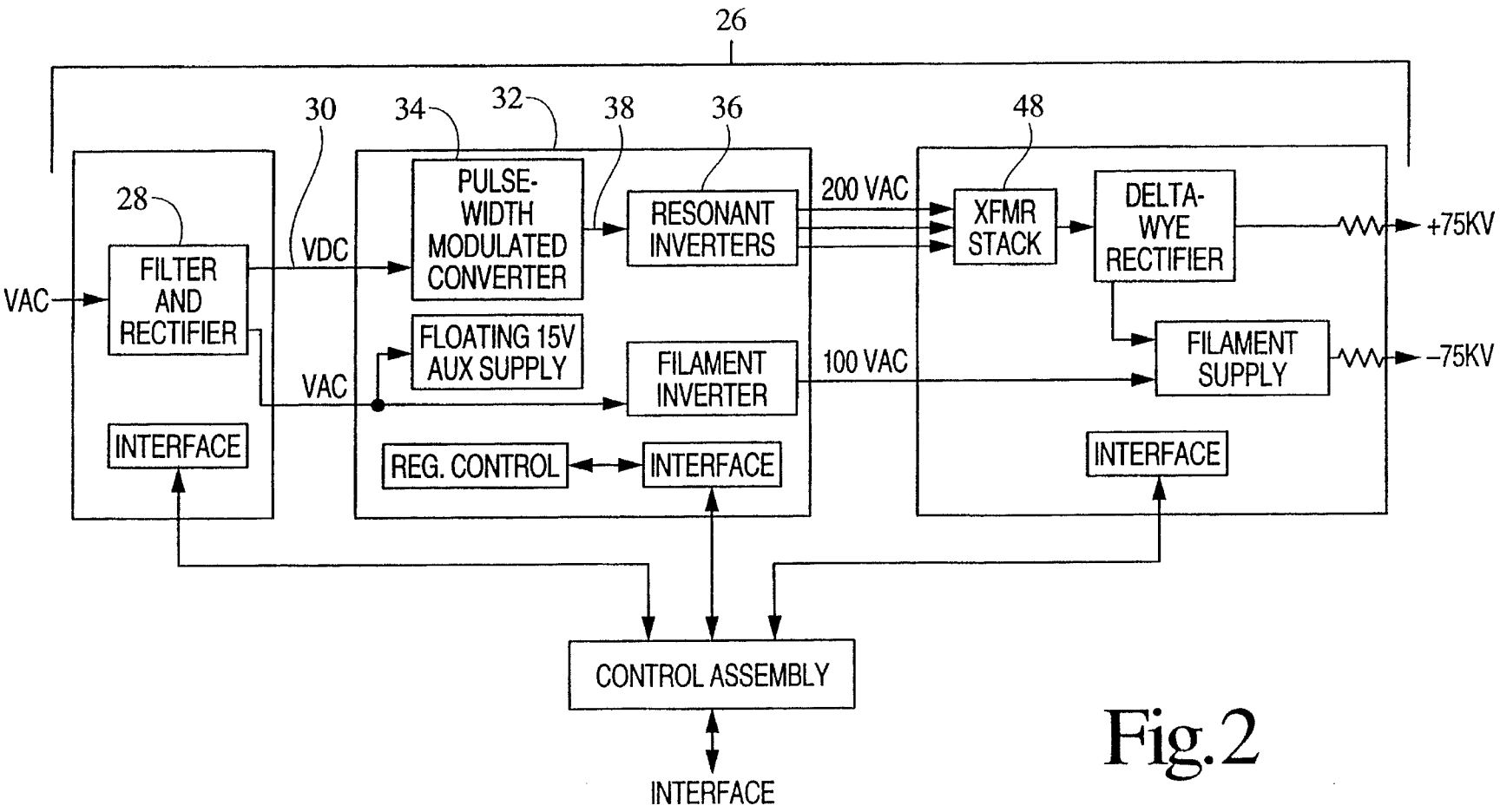
FIG. 2 is a block diagram of a high-voltage power supply for the CT scanner of FIG. 1 in accordance with the present invention.

With reference to FIG. 2, the x-ray tube 12 is driven by a power supply 26. The power supply 26 receives as input raw alternating line current power into a filter and rectifier 28. The filter and rectifier 28 converts the raw alternating current power into a relatively low voltage direct current which is outputted on a bus 30 to a converter assembly 32 which performs a power conversion.

In the preferred embodiment, the converter assembly 32 includes two cascaded power converter stages. The first stage includes a pulse-width modulated converter 34 and the second stage includes resonant inverters 36 which operate at or near resonance. The pulse-width modulated converter 34 is connected to the resonant inverters 36 by a bus 38.

The direct current from the filter and rectifier 28 is received by the pulse-width modulated converter 34 across the bus 30. The pulse-width modulated converter 34 steps the voltage down and the current up. The pulse-width modulated converter 34 operates at about 50 kHz and is hard-switched, and generates a duty-cycle modulated output. Alternately, the pulse-width modulated converter 34 can be replaced by frequency-modulation of the resonant inverters 36.

Figure 3:
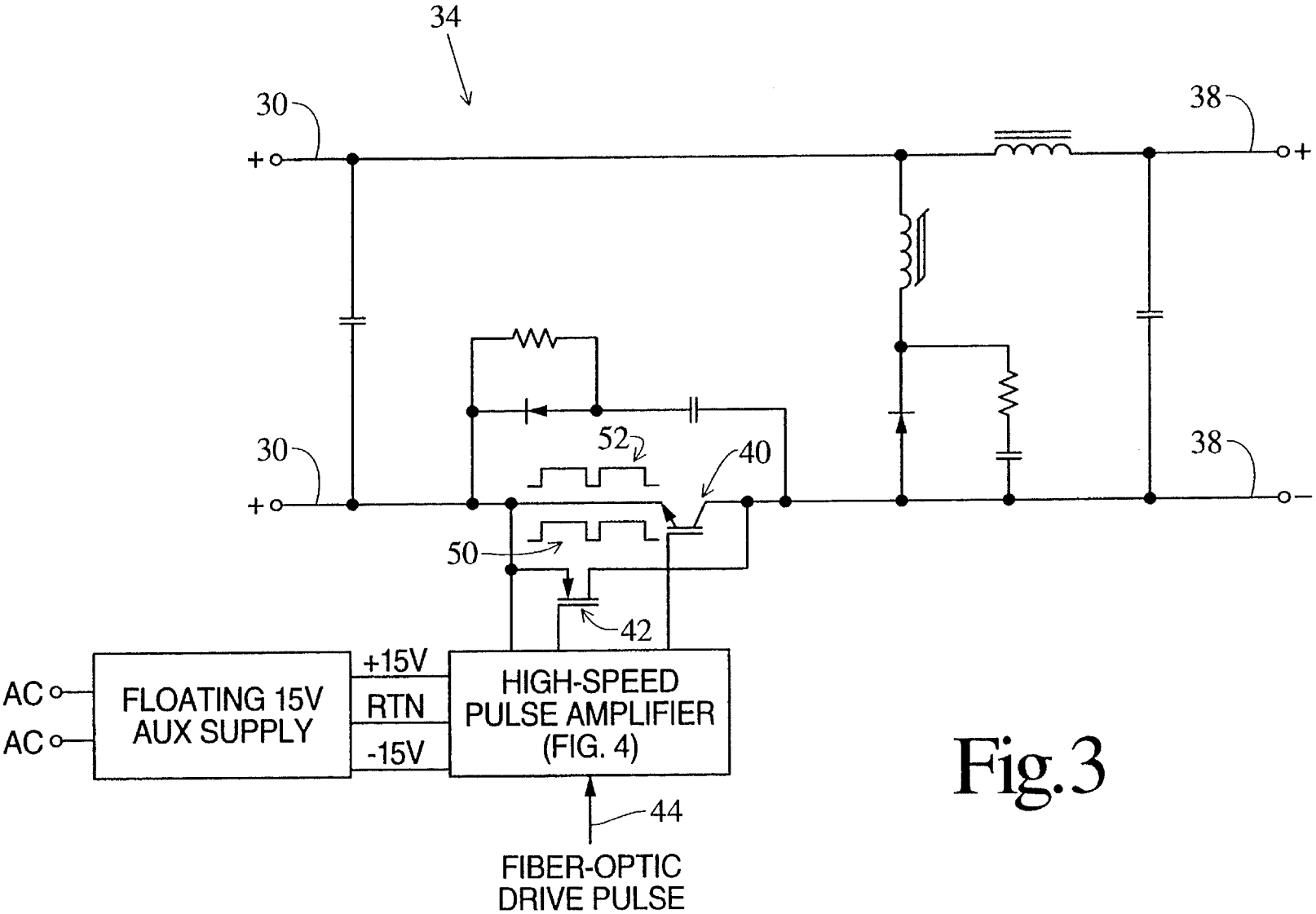
FIG. 3 is a schematic of the pulse-width modulated converter of FIG. 2.

With reference to FIG. 3, the pulse-width modulated converter 34 includes an IGBT 40 and a MOSFET 42 connected in parallel. The IGBT 40 operates as a switching mechanism while the MOSFET 42 is an auxiliary switch, operating to handle turn-off power dissipation. In operation, the IGBT 40 turns off before MOSFET 42 such that the MOSFET eliminates turn-off losses in the slower IGBT 40. Alternately, using a faster IGBT eliminates the need for the MOSFET 42.

Figure 4:
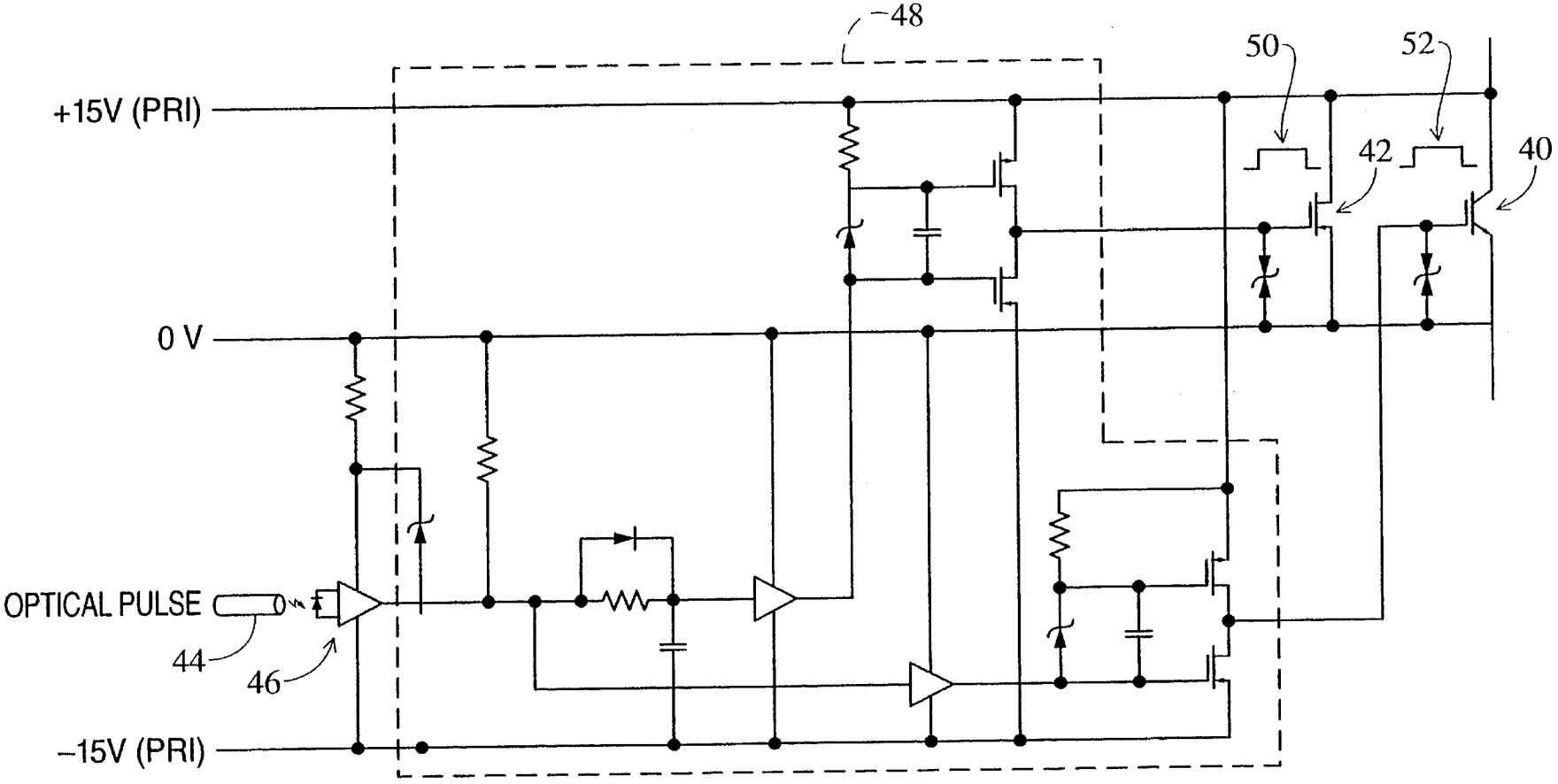
FIG. 4 illustrates agate drive circuit of the pulse-width modulated converter.

With reference to FIG. 4, a light signal, preferably a 50 kHz light signal, is received on an optical waveguide 44. An optical to electrical transducer 46 converts the optical pulses to corresponding electrical pulses. A pulse shaping and conditioning circuit 48 converts the 50 kHz pulses into a pair of corresponding squarewave pulses 50, 52. Pulses 50 and 52 have a common leading edge. However, the trailing edge of pulse 50 is delayed about 1/10th cycle beyond the trailing edge of pulse 52. The pulses 50, 52 are applied to the IGBT switching device 40 and the MOSFET switching device 42. The trailing edge of the pulse 50 which is applied to the MOSFET switching device 42 is delayed about 1/10th cycle relative to the trailing edge of pulse 52. This causes the MOSFET 42 to remain conductive for a short duration beyond the IGBT 40. In this manner, a 50 kHz pulse-width modulated signal is generated for transmission on the bus 38 to the resonant inverters 36.

Figure 5:
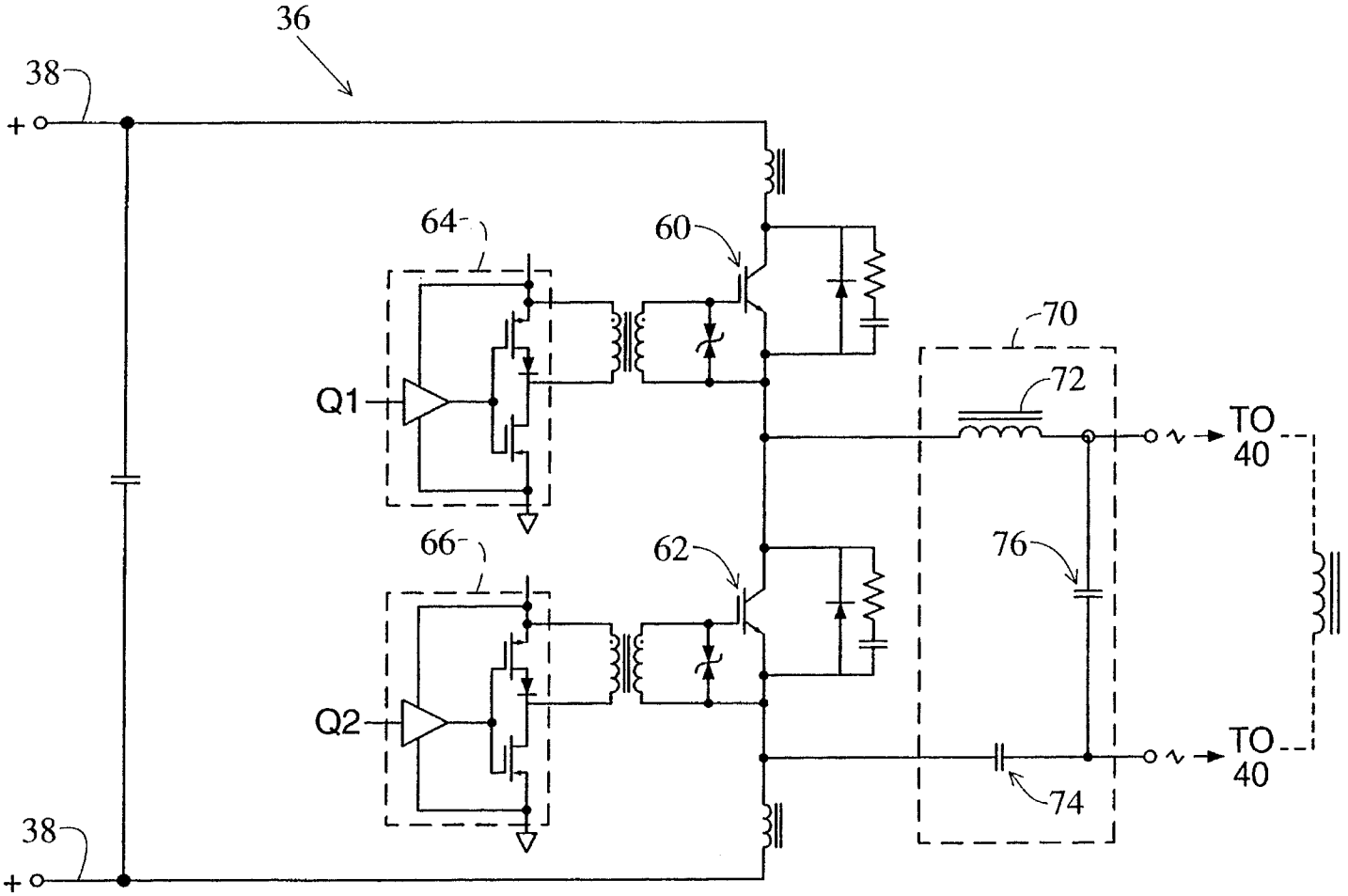
FIG. 5 is a schematic of the resonant inverter of FIG. 2.

With reference to FIGS. 2 and 5, the resonant inverters 36 receive input from the pulse-width modulated converter 34 across bus 38. The resonant inverters 36 convert the input to about a 50 kHz alternating current as shown in FIG. 5. The resonant inverters are soft-switched, series-parallel inverters operating at or near resonance for optimum power transfer. IGBTs 60 and 62 rated at about 600 volts each with zero-crossing operation, low peak current, and no-ring-back current are included to maintain efficiency under all conditions.

Figure 6A:
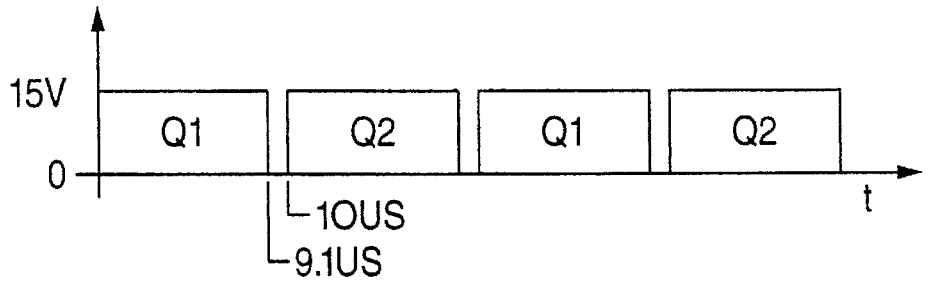
FIGS. 6A–6D show waveforms of the resonant inverter.
Figure 6B:
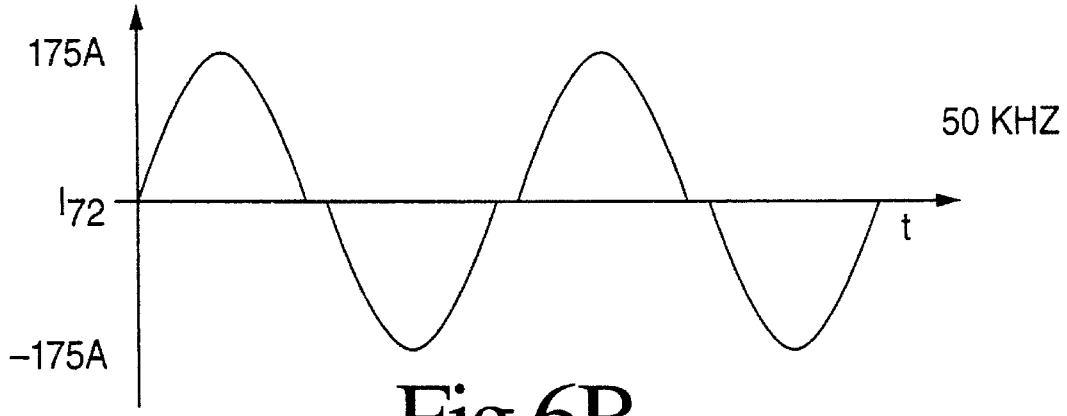
Figure 6C:
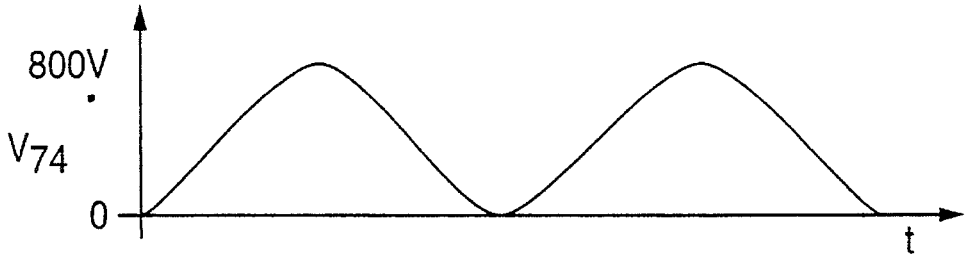
Figure 6D:
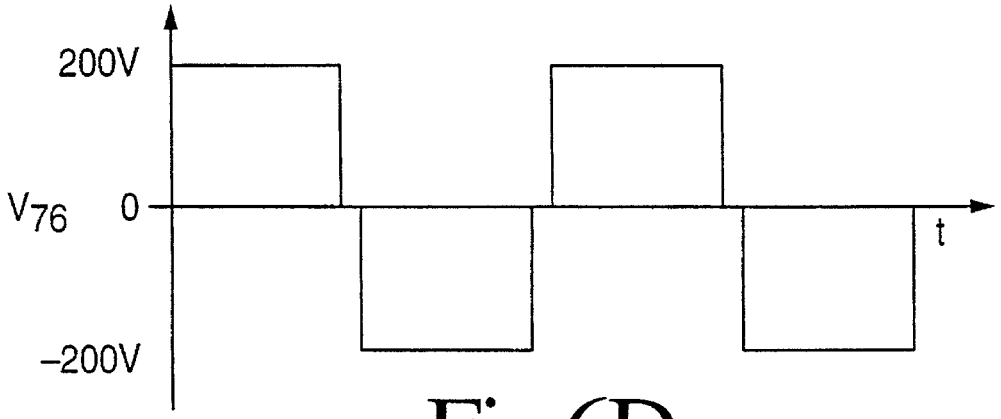

The pair of IGBT switching devices are gated asynchronously by a corresponding pair of pulse amplifiers 64, 66. Control pulses Q1, preferably 50 kHz pulses, are applied to the pulse amplifier 64 and pulses Q2, 180° out of phase with pulses Q1, are applied to the pulse amplifier 66. The IGBT switching devices 60, 62 are connected with a $\pi$ resonant circuit 70. FIG. 6B illustrates the current flow across inductor 72 and FIG. 6C illustrates the corresponding voltage across capacitor 74. FIG. 6B illustrates the output current-through inductor 72. In this manner, the inverters convert the pulse-width modulated DC current from the pulse-width converter 34 to alternating sinewave current which is conveyed to an output stage 80.

Figure 7A:
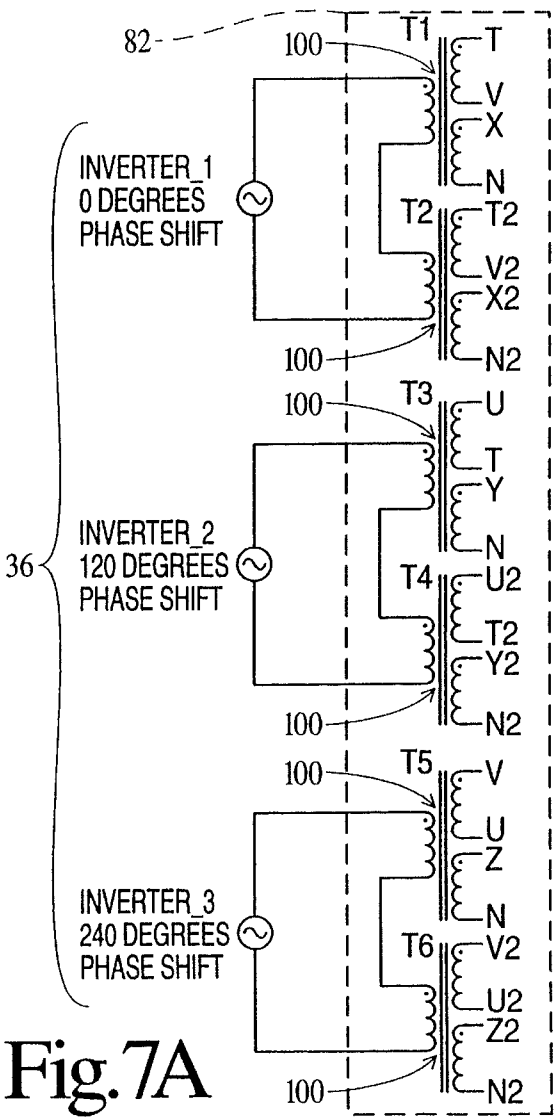
FIGS. 7A–7C illustrate delta-wye connections of the straight-up transformer.

With reference to FIG. 7A, in the preferred embodiment, the resonant inverters 36 include three resonant inverters configured in parallel, each operating at 120 electrical degrees apart from one another and sharing an equal load. A sinusoidal output current from each of the three resonant inverters are phase shifted 120° from each other by a phase shifter. The outputs are then received by primary windings of a straight-up transformer stack 82.

Figure 7B:
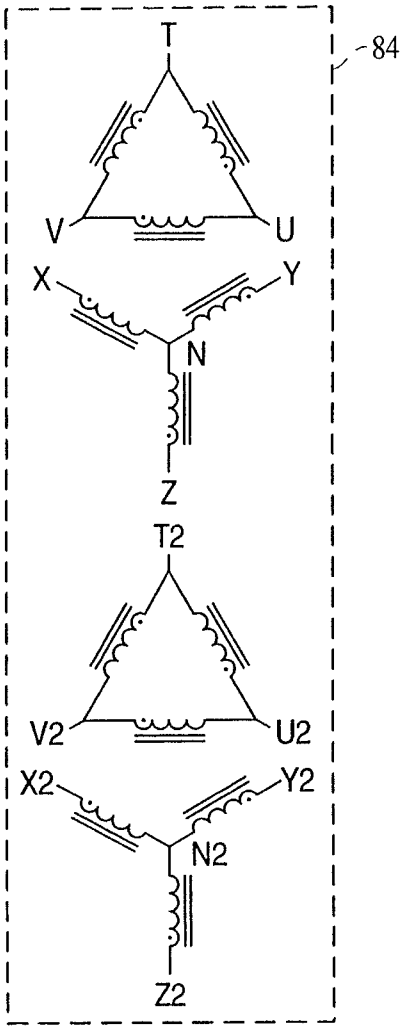
Figure 7C:
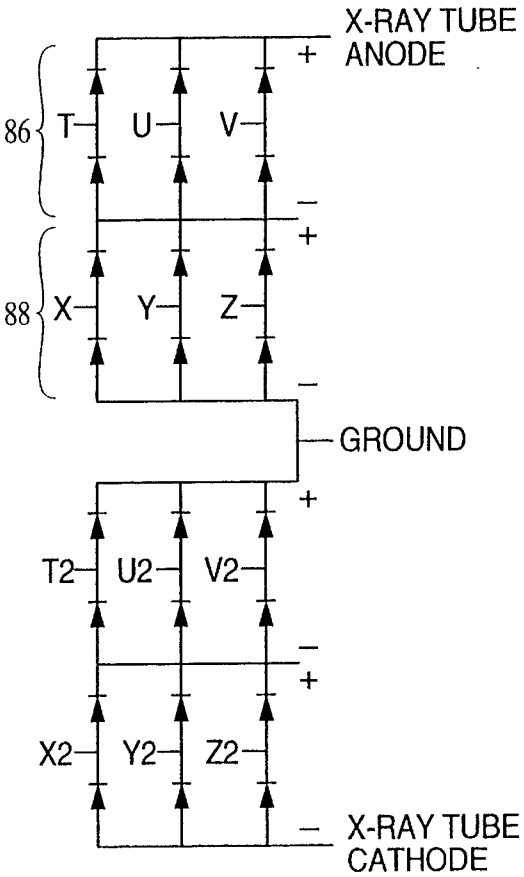

With reference to FIGS. 7B and 7C, secondary windings of each transformer in the straight-up transformer stack 82 are connected in a delta-wye configuration 84 to three-phase, full-wave bridge rectifiers 86, 88. No voltage multipliers or filter capacitors are provided. Each end of each secondary winding is labeled with its point of connection. The ends are then connected to diodes of rectifiers 86 and 88 as shown in FIG. 7C. This differs from the 12-pulse rectification scheme employed in line-frequency generators in the prior art in which the anode and cathode side outputs are either delta or wye, but not both. Applying the preferred embodiment to a high-frequency switching power supply results in a near zero output capacitance requirement and near-zero stored energy. The need for complex resistor-diode-inductor networks to limit arc current is eliminated.

With further reference to FIGS. 7A, 7B, and 7C, in the preferred embodiment, six transformers T1 through T6 are used. Each transformer has a primary winding and two secondary windings. A first secondary winding of each transformer is connected to each corresponding first winding in a delta configuration. A second secondary winding of each transformer is connected to each corresponding second winding in a wye configuration.

Figure 8A:
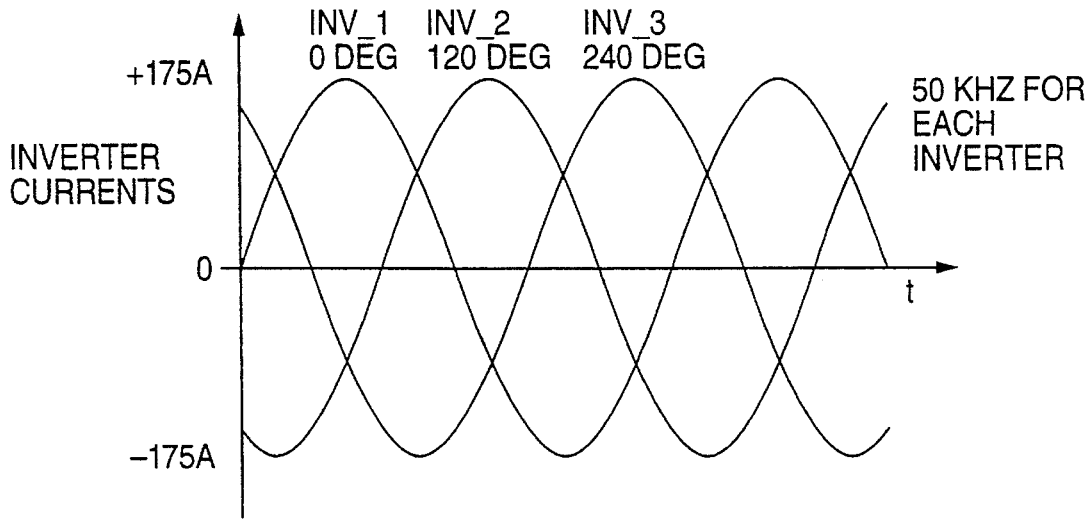
FIG. 8A illustrates inverter current waveforms of the delta-wye outputs.
Figure 8B:
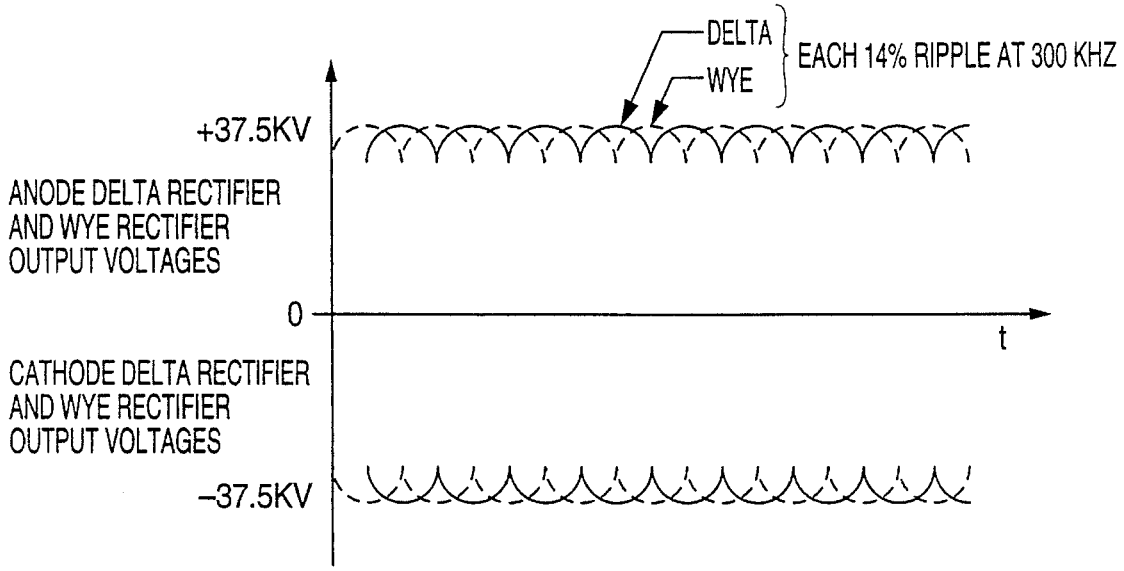
FIG. 8B illustrates anode and cathode voltages relative to ground.
Figure 8C:
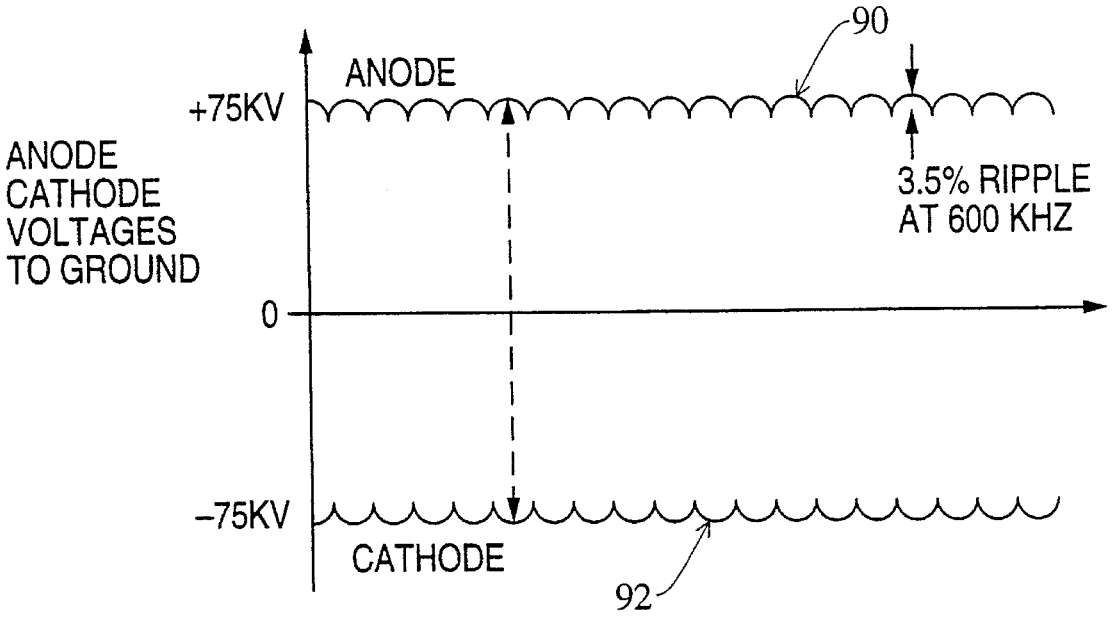
FIGS. 8C and 8D illustrate anode to cathode voltage relationships.
Figure 8D:
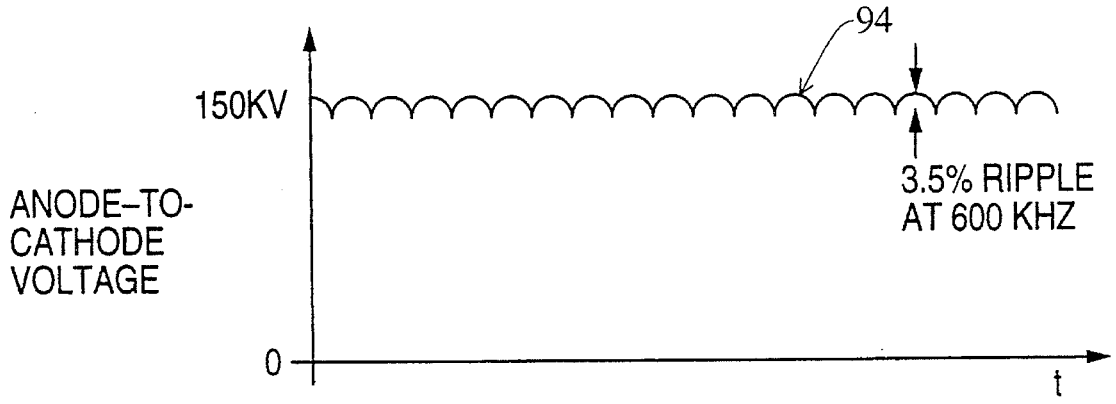

As illustrated in FIG. 8A, the outputs of the inverters 36 are 120° out of phase. With reference to FIG. 8B, the voltage outputs from the delta connection at rectifier 86 and the wye connection at rectifier 88 each have about 14% ripple at 300 kHz. With reference to FIG. 8C, the output voltages from the delta and wye rectifier connections are summed to produce anode and cathode voltages with respect to ground with only about 3.5% ripple at 600 kHz. The summation of the three-phase delta and wye configurations results in a very low ripple voltage at twelve times the inverter switching frequency. It will be noted that the pulse train 90 is in phase with respect to the pulse train 92. Therefore, no common-mode ripple voltage to ground exists at the anode and cathode as in the prior art which can distort the electron beam. With reference to FIG. 8D, a summation of the anode voltage 90 with the cathode voltage 92 across the x-ray tube produces a pulse train 94. The resulting voltage across the x-ray tube has only about 3.5% ripple with 150 kV output in the preferred embodiment has been achieved without added capacitance.

Figure 9:
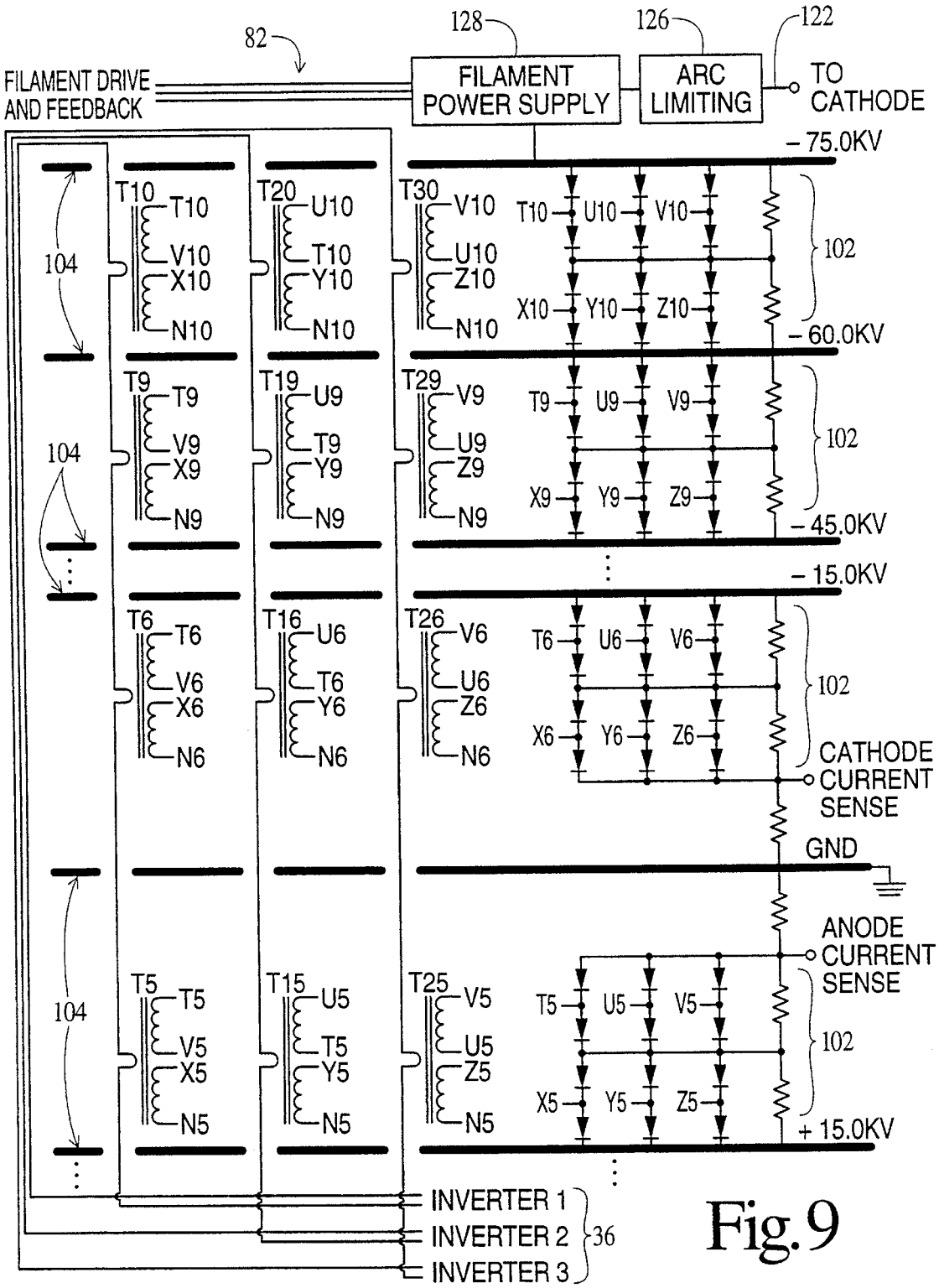
FIG. 9 illustrates a schematic of the transformer stack.
Figure 10:
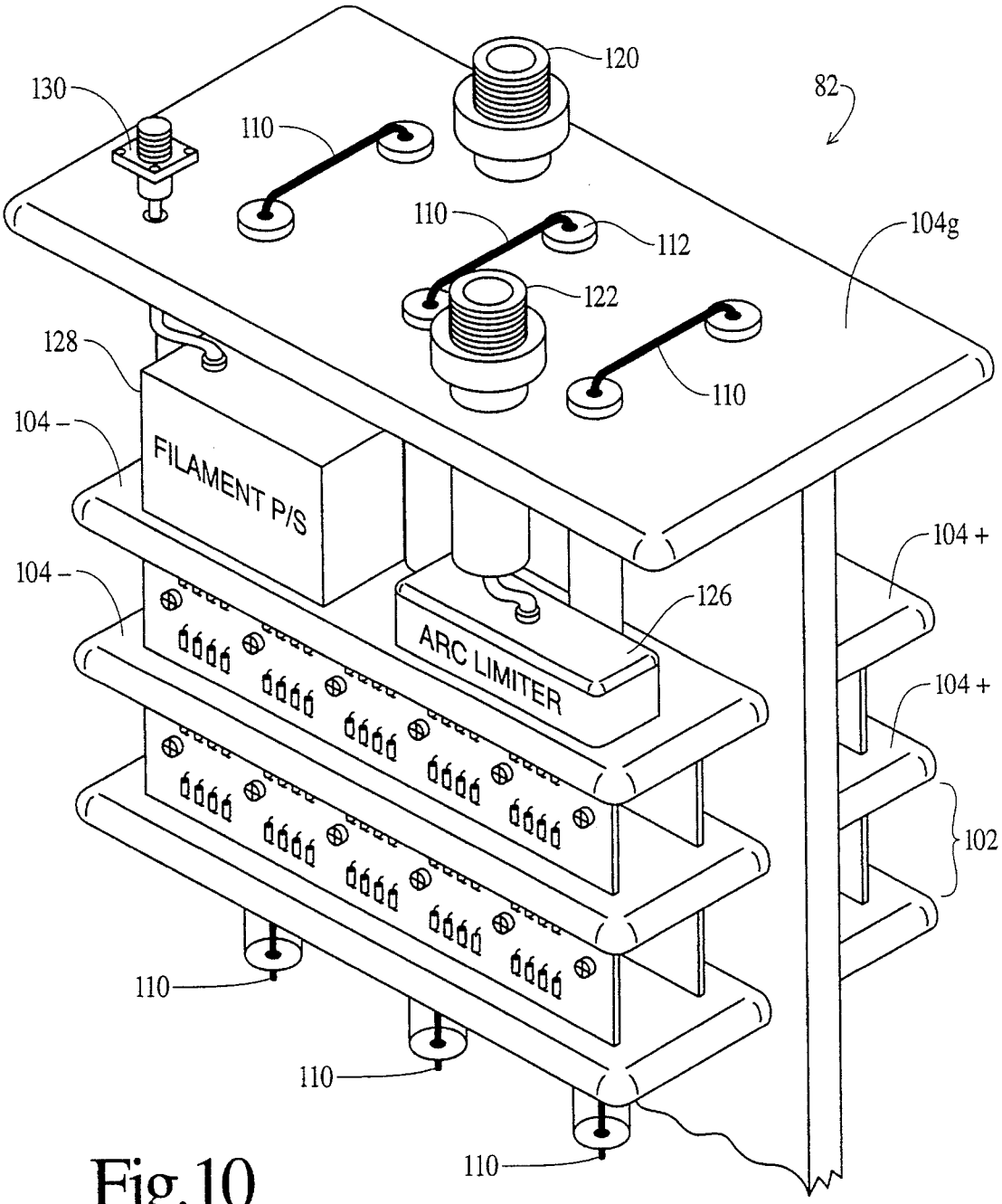
FIG. 10 is an isometric view of the transformer and rectifier stack.
Figure 11:
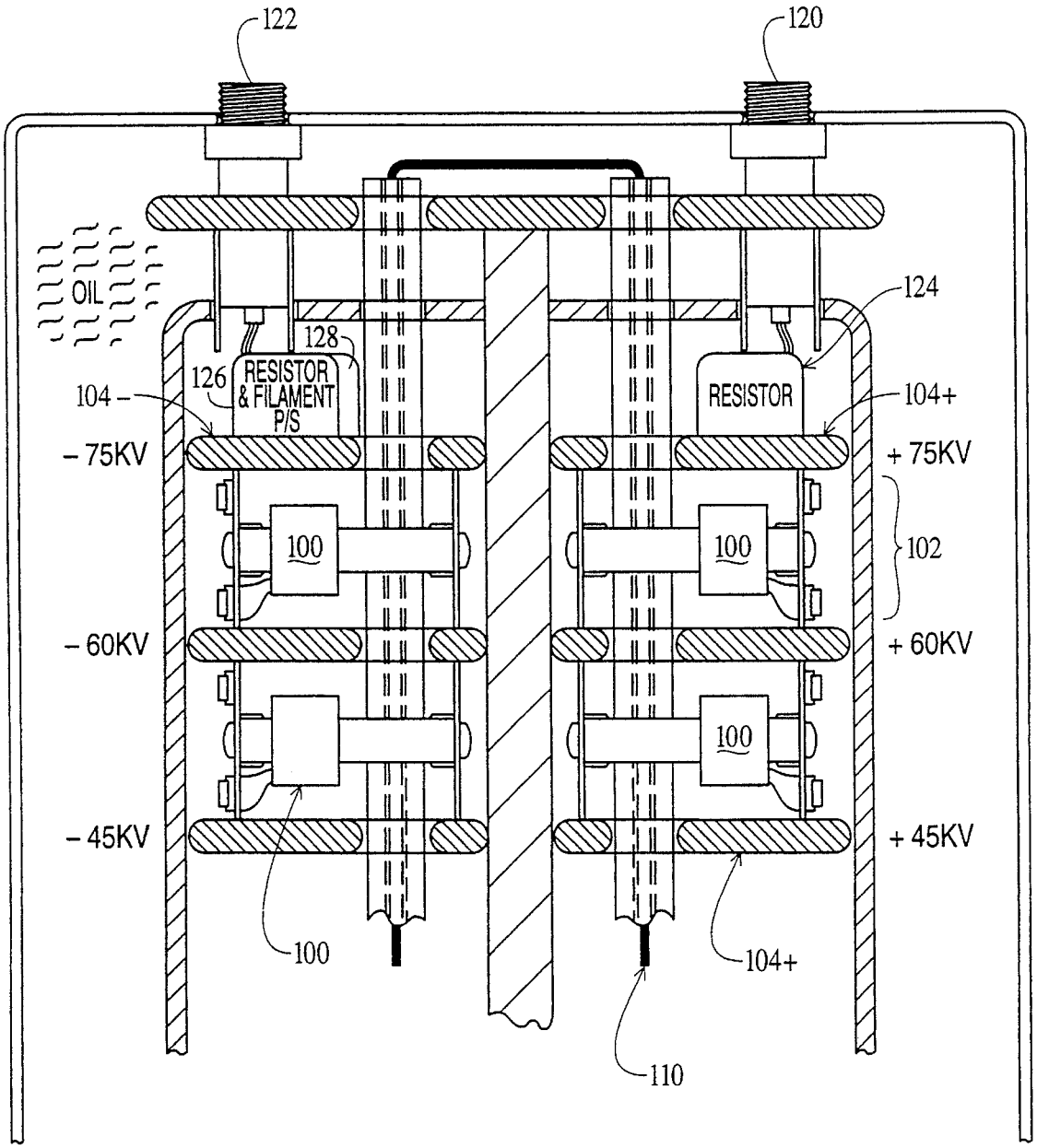
FIG. 11 is a view in partial section of the transformer stack.

With reference to FIGS. 9–11, the transformer stack 82 includes a number of straight-up transformers 100 stacked into cascaded circuit sections 102. Contoured parallel plates 104 separate the cascaded circuit sections 102 which operate independent of each other and external geometries. The parallel plates 104 grade voltage uniformly. In the preferred embodiment shown in FIG. 10, there are 10 circuit sections 102, with 10 rectifier circuits 86 for a total of 120 diodes and 30 transformers 100. Other numbers of circuit sections may be formed by adding or subtracting sections. Each section "floats" on the adjacent sections. In the preferred embodiment, each section has an output voltage of about 15 kV. Correspondingly, each plate 104 is only 15 kV offset from adjacent plates. This structure eliminates high electric-field gradients. The entire assembly is vacuum impregnated in oil which provides component cooling and high dielectric strength.

With particular reference to FIG. 10, the plurality of the circuit sections 102 each have a series of +kV plates 104+ on one side and a series of –kV plates on the opposite side with a ground plate 104*g* on top of the 104– stack. Between the pair of plates 104 which are separated by 15 kV, in the preferred embodiment, each section includes three transformers 100, delta-wye interconnection among the transformers, and the rectifiers 86.

Figure 12:
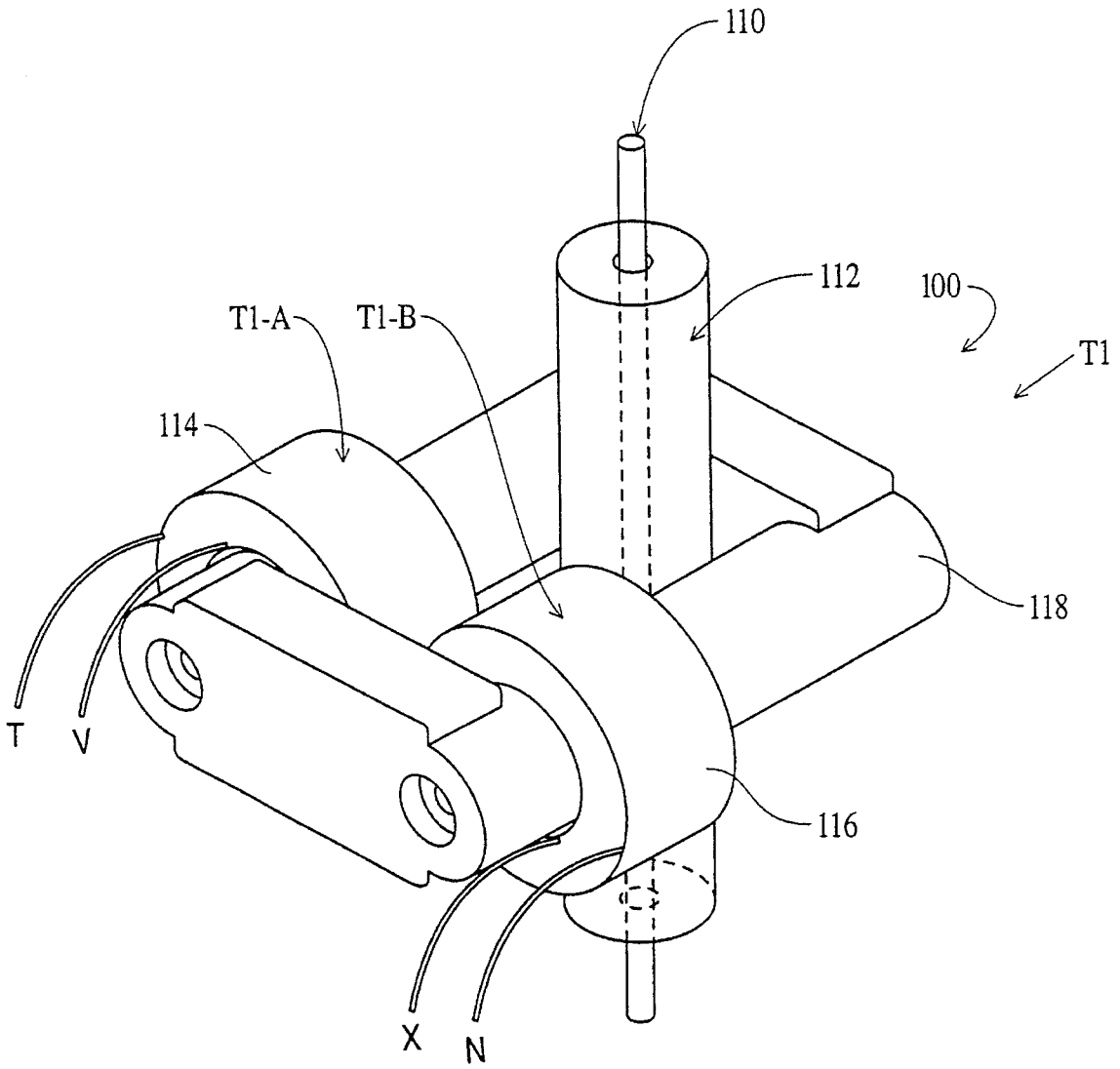
FIG. 12 is an isometric of a transformer in accordance with the present invention.

With continuing reference to FIG. 11 and further reference to FIG. 12, each of the transformers includes a primary winding 110. Due to the high-frequencies, the primary winding of the preferred embodiment is a single wire which extends through one of the three transformers in each of the sections. Each primary winding is shielded by an insulating jacket 112, such as a polycarbonate tube. A pair of secondary windings 114 which is connected in the delta pattern and 116 which is connected in the wye pattern are magnetically coupled to the primary winding 110. In particular, a ferrous core 118 extends in a loop around the primary winding and through an axial center of the two secondary windings.

The x-ray tube 12 is connected to the power supply 26 by an anode connector 120 and a cathode connector 122. The anode connector 120 and the cathode connector are each connected with an arc limiter 124 and 126 respectively as shown in FIGS. 10 and 11. A filament power supply 128 is disposed on the negative side of the transformer stack. The filament power supply has a filament drive connector 130 on which a filament heating current is provided at the cathode potential.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A radiographic scanner comprising:

a patient receiving region defined within a stationary gantry;

an x-ray tube mounted on a rotating frame for rotation about the patient receiving region, the x-ray tube selectively transmitting x-rays across the patient receiving region;

radiation detectors for detecting radiation which has traversed the patient receiving region and generating signals indicative of the radiation detected; and a high-frequency power source supplying power to the x-ray tube, the high-frequency power source having a plurality of straight-up transformers which receive an alternating current and which transform the alternating current into a high-frequency high-voltage output in at least a kilohertz range, the straight-up transformers having a plurality of secondary windings connected in a delta-wye configuration, the delta-wye configuration being connected by diodes with the x-ray tube.

2. The radiographic scanner as set forth in claim 1 wherein the plurality of straight-up transformers operate independently of each other and are stacked in a plurality of circuit sections with each circuit section including three of the plurality of straight-up transformers, each of the three straight-up transformers having two secondary windings, one of the secondary windings of each transformer being connected in a delta configuration and the other secondary winding of each pair being connected in a wye configuration.

3. The radiographic scanner as set forth in claim 2 wherein each of the plurality of circuit sections are separated by a conductive plate for grading voltage uniformly from section to section.

4. The radiographic scanner as set forth in claim 1 further including:

a pulse-width modulated converter operating at least at 50 kHz, the pulse-width modulated converter receiving a direct current and generating a modulated output current; and a plurality of resonant inverters for converting the modulated output current into the alternating current received by the high-frequency power source.

5. The radiographic scanner as set forth in claim 4 further including an opto-electric transducer for receiving light signals from an optic fiber and controlling the pulse-width modulated converter in accordance therewith.

6. The radiographic scanner as set forth in claim 4 wherein the pulse-width modulator includes:

an IGBT transistor and an FET transistor connected in parallel; and a gate drive circuit which cyclically gates the IGBT and FET transistors conductive concurrently and gates the IGBT transistor non-conductive a fraction of a cycle in advance of the FET transistor.

7. The radiographic scanner as set forth in claim 1 wherein the power source is free of added capacitance, and further including at least one cable for connecting the power source to the x-ray tube.

8. The radiographic scanner as set forth in claim 1 further comprising:

an image reconstruction processor for reconstructing an image representation from the signals generated by the radiation detectors.

9. A radiographic scanner including an x-ray tube, a high-voltage power supply for the x-ray tube, a patient receiving region, the x-ray tube mounted adjacent the patient receiving region for transmitting x-rays across the patient receiving region, a radiation detector for detecting radiation which has traversed the patient receiving region, the high-voltage power supply being configured in a compactly stacked plurality of circuit sections operating independently of each other, each of the plurality of circuit sections being separated by parallel plates for grading voltage uniformly, each of the plurality of circuit sections including:

three straight-up transformers each having a pair of secondary windings connected in a delta-wye configuration, such that an alternating current is received by the straight-up transformers and converted into a high-frequency high-voltage output that is conveyed to the x-ray tube.

10. The radiographic scanner as set forth in claim 9 wherein the high-frequency high-voltage output from the plurality of sections is rectified and summed and further including a phase shift means for shifting the relative phase of the high-frequency high-voltage output of the plurality of sections to reduced ripple in the sum.

11. A high-voltage power supply for x-ray tubes comprising:

a pulse-width modulated converter which receives a direct current and generates a conditioned direct current output;

a plurality of inverters operating at or near resonance the inverters receiving the conditioned direct current output from the pulse-width modulated converter, each of the plurality of inverters converting the conditioned direct current output to at least a 50 kHz alternating current;

a plurality of sections for boosting a voltage of the at least 50 kHz alternating current;

a circuit for combining the voltage boosted at least 50 kHz alternating current output from the plurality of voltage boosting sections, the circuit being connected with the x-ray tube.

12. A radiographic apparatus comprising:

an x-ray tube;

a high-voltage power supply for the x-ray tube including:

a pulse-width modulated converter which receives a direct current and generates a conditioned direct current output;

a plurality of inverters operating at or near resonance, the inverters receiving the conditioned direct current output from the pulse-width modulated converter, each of the plurality of inverters converting the conditioned direct current output to at least a 50 kHz alternating current;

a plurality of sections for boosting a voltage of the at least 50 kHz alternating current;

a circuit for combining the voltage boosted at least 50 kHz alternating current output from the plurality of voltage boosting sections, the circuit being connected with the x-ray tube;

a radiation detector disposed across a patient receiving region from the x-ray tube for receiving radiation from the x-ray tube that has passed through the patient receiving region.

13. The radiographic apparatus as set forth in claim 12 wherein the plurality of sections are configured in a plurality of cascaded stages operating independently of one another, each cascaded stage being mounted on one of a plurality of parallel plates, the plates grading voltage uniformly and eliminating high electric field gradients.

14. The radiographic apparatus as set forth in claim 3 wherein each section has a plurality of straight-up transformers having secondary windings connected in a delta-wye configuration, the delta-wye configuration being connected with an added capacitance-free rectifier.

15. The radiographic apparatus as set forth in claim 13 wherein the plurality of straight-up transformers include a first transformer having a first primary winding and a first pair of secondary windings, a second transformer having a second primary winding and a second pair of secondary windings, a third transformer having a third primary winding and a third pair of secondary windings, the first, second, and third transformers being connected such that one of the secondary windings of each of the first, second, and third transformers are connected to form a delta configuration, and the other secondary winding of the first, second, and third transformers are connected to form a wye configuration.

16. In a radiographic scanner including an x-ray tube, a high-voltage power supply for the x-ray tube in which voltage is boosted by transformers, and a radiation detector disposed across an examination region from the x-ray tube to receiving radiation that has traversed the examination region, THE IMPROVEMENT COMPRISING:

a source of high-frequency alternating current which produces at least three phase shifted components;

at least three straight-up transformers, each having (i) a primary winding connected with the high-frequency alternating current source to receive one of the phase shifted components and (ii) at least two secondary windings;

a summing circuit for summing the components from the secondary windings of the straight-up transformers, the summing circuit producing a high-voltage direct current output including a low-ripple, high-frequency component in at least a kilohertz range which is outputted to the x-ray tube to supply power thereto.

17. In the radiographic scanner as set forth in claim 16, wherein the improvement further comprises:

a compactly stacked plurality of circuit sections each including three straight-up transformers and a summing circuit, the plurality of circuit sections being separated by contoured parallel plates for grading voltage uniformly.

18. In the radiographic scanner as set forth in claim 16, the improvement further comprising:

the summing circuit including a delta-wye interconnection among the straight-up transformer secondary windings.

19. In the radiographic scanner as set forth in claim 16, the improvement further comprising:

the source of high-frequency alternating current including resonant inverters for conditioning and converting an input power by frequency modulation to generate the high-frequency alternating current.

20. A method for radiographic imaging comprising:

pulse-width modulating a direct current to generate a conditioned direct current output;

converting the conditioned direct current output to an alternating current of at least 50 kHz;

dividing the alternating current into three components and phase shifting the components relative to each other;

boosting the voltage of each component;

combining the voltage boosted components with a delta-wye configuration with its outputs connected in series to create a high-frequency, high-voltage current;

rectifying the high-frequency, high-voltage current;

supplying the rectified current to the x-ray tube to cause the generation of x-rays;

passing the generated x-rays through a patient in a patient receiving region;

detecting the radiation which has passed through the patient to generate a diagnostic image.

21. The method of radiographic imaging as set forth in claim 20 wherein the rectified high-frequency, high-voltage current has a voltage ripple of 3.5% or less at about a 600 kHz frequency.

22. The method of radiographic imaging as set forth in claim 20 wherein the converting step includes operating a plurality of inverters at or near resonance.

23. A method for generating high-voltage power for an x-ray tube of a radiographic scanner comprising:

pulse-width modulating a direct current to generate a conditioned direct current output;

converting the conditioned direct current output to an alternating current of at least 50 kHz;

dividing the alternating current into three components and phase shifting the components relative to each other;

boosting the voltage of each component;

combining the voltage boosted components with a delta-wye configuration with its outputs connected in series to create a high-frequency, high-voltage current; and, rectifying the high-frequency, high-voltage current and supplying the rectified current to the x-ray tube.

* * * * *